United States Patent [19]

Matsuzaki

[11] 4,194,560

[45] Mar. 25, 1980

[54] OIL COOLER AND METHOD FOR FORMING IT

[75] Inventor: Yoshiaki Matsuzaki, Musashino, Japan

[73] Assignee: Nihon Radiator Co., Ltd., Nakano, Japan

[21] Appl. No.: 944,107

[22] Filed: Sep. 20, 1978

Related U.S. Application Data

[63] Continuation-in-part of Ser. No. 771,495, Feb. 24, 1977, abandoned.

[30] Foreign Application Priority Data

Mar. 19, 1976 [JP] Japan ..... 51-32247

[51] Int. Cl.[2] ..... F28D 7/10

[52] U.S. Cl. ..... 165/141; 165/155; 165/DIG. 23

[58] Field of Search ..... 165/140, 141, 154, 155, 165/DIG. 13; 184/104 B

[56] References Cited

U.S. PATENT DOCUMENTS

| | | | |
|---|---|---|---|
| 1,787,904 | 1/1931 | Heyward | 165/154 |
| 2,993,682 | 7/1961 | Huet | 165/141 |
| 3,358,749 | 12/1967 | Chisholm et al. | 165/141 |
| 4,004,634 | 1/1977 | Habdas | 165/141 |

*Primary Examiner*—Sheldon Richter

*Attorney, Agent, or Firm*—Blum, Kaplan, Friedman, Silberman & Beran

[57] ABSTRACT

A built-in oil cooler, comprising an outer tube and an inner tube, the latter tube is provided with a plurality of dent and projection portions alternately formed on its surface in axial direction thereof. Said inner tube is inserted in said outer tube to keep its outside face having no dent portion in contact with inside face of said outer tube, forming oil space between both of said tubes. Oil within said oil space flows zigzag to assure very good heat transfer rate.

6 Claims, 20 Drawing Figures

OIL COOLER AND METHOD FOR FORMING IT

RELATED UNITED STATES APPLICATION DATA

This application is a continuation-in-part application of application Ser. No. 771,495, filed on Feb. 24, 1977, and now abandoned.

BACKGROUND OF THE INVENTION

This invention relates to an improvement of oil cooler built in a radiator for cooling oil for a torque converter or for engine lubrication.

In a conventional oil cooler built in an radiator as shown in FIG. 1, a tubular oil cooler is fitted in a lower tank 2 (horizontal tank in case of horizontal flow type radiator) of a radiator 1, and within said cooler 3, oil for a torque converter and for engine lubrication and the like are circulated by way of oil ducts 4, 5 which are communicated with said cooler 3, and the oil is cooled by cooling water for engine. Such an oil cooler is in principle as shown in FIG. 2, wherein an inner tube 7 is inserted in an outer tube 6, expanded ends 8 of the inner tube 7 are closely attached to the outer tube 6, oil ducts 4, 5 are communicated with oil space 15 formed between the outer and inner tubes 6, 7 watertightly penetrating the wall of lower tank with packings 9, 10 to circulate oil within said cooler, thus to cool oil flowing through said oil space by cooling water inside of the inner tube 7 and outside of the outer tube 6. In fact, for the purpose of improving heat transfer rate of such an oil cooler, usually, as shown in FIG. 3, fins 11 are inserted between the outer tube 7 and the inner tube 7, and as shown in FIG. 4 to FIG. 7, dent portions 12, 12 and 12*a*, 12*a*, which are respectively making a pair, are alternately formed on upper and lower sides as well as right and left sides as an inner tube 7, which tube is inserted in the outer tube 6 so as to leave a gap 13 between the inner tube side without dent portions and the outer tube 6, so that the oil flowing through the oil space 15 between the inner and outer tubes was disturbed. In such a usual construction, when fins are inserted therein, it becomes not only complicated, requiring much time and high cost, but also straight flow of oil is increased, resulting in poor heat transfer rate, and when an inner tube 7 provided with dent portions 12, 12, 12*a* and 12*a* is used, deformation of flat portions 7*a*, 7*b* formed by said dent portions 12, 12, 12*a* and 12*a* due to oil pressure flowing within the oil cooler becomes large, resulting in damage due to the fatigue of material.

SUMMARY OF THE INVENTION

Generally speaking, in accordance with the invention, an improved counter-current flow oil cooler is provided. The oil cooler includes a coaxial inner tube and an outer tube. The inner tube is formed with a plurality of dent portions and projections alternatively formed in the axial direction on the outer surface. The projecting portions have an outer diameter substantially the same as the inner diameter of the outer tube for contacting the inner wall of the outer tube. The dent portions on the inner tube form oil spaces between the tubes thereby allowing oil to flow in zigzag fashion along the length of the tubes.

In a preferred embodiment of the invention, the dent portions are formed in a series having an odd number of dents at a transverse plane thereby forming a cross-section of a regular polygon of an odd number of sides with rounded apexes for contacting the inner wall of the outer tube. Each series of dent portions has the same number of dents with an adjacent series rotated from the first series so that the dent portions occur at the angle of the apexes of the first series. The third series is rotated to be in alignment with the first of the series. The series are rotated alternatively so that the interior of the inner tube appears to have a cross-section of a regular polygon having twice the number of sides as each series of dents. Preferably, each series of dent portions has three dents.

Accordingly, it is an object of the invention to provide an improved oil cooler.

Another object of the invention is to provide an oil cooler providing improved heat transfer.

A further object of the invention is to provide an improved oil cooler formed with a plurality of dent portions on the surface of an inner tube.

Still another object of the invention is to provide an improved oil cooler of simplified construction.

Another object of the invention is to provide an improved oil cooler which overcomes the disadvantages of conventional oil coolers.

Still other objects and advantages of the invention will in part by obvious and will in part be apparent from the specification and drawings.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawing, in which:

FIG. 8 to FIG. 14 show the 1st example of this invention, in which:

FIG. 8 is a partial longitudinally sectioned front view of an oil cooler;

FIG. 9 is a sectional view along D—D line of FIG. 8;

FIG. 10 is also a sectional view along E—E line of FIG. 8;

FIG. 11 and FIG. 12 show the 2nd example, each being similar sectional view to FIG. 9 and FIG. 10;

FIG. 13 and FIG. 14 are longitudinally sectioned views, showing the state of fitting an inner tube within an outer tube;

DESCRIPTION OF THE PREFERRED EMBODIMENTS

Figure 1:
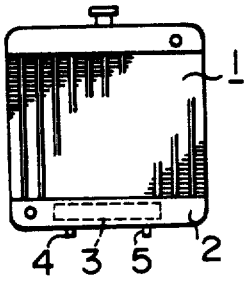
FIG. 1 (PRIOR ART)
FIG. 1 is a front view of a radiator having built-in cooler.
Figure 3:
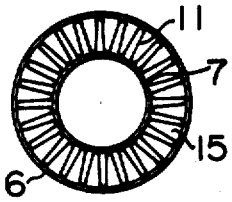
FIG. 3 (PRIOR ART)
FIG. 3 is a sectional view along A—A line of FIG. 2, showing the state of inserted fins.
Figure 2:
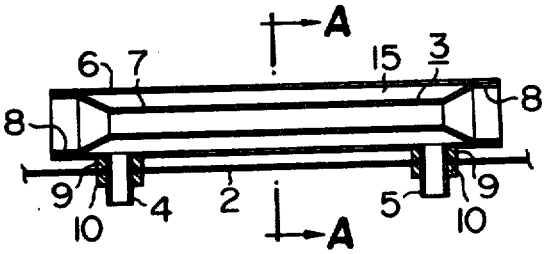
FIG. 2 (PRIOR ART)
FIG. 2 is a longitudinally sectioned front view of a usual built-in oil cooler.
Figure 4:
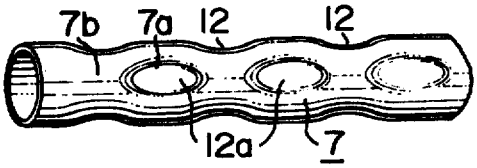
FIG. 4 (PRIOR ART)
FIG. 4 is a perspective view of an inner tube provided with dents.
Figure 5:
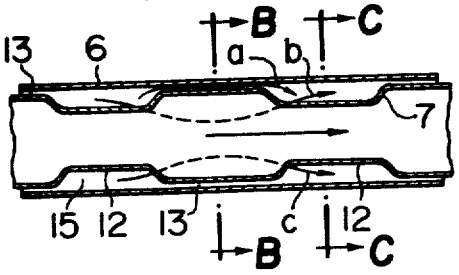
FIG. 5 (PRIOR ART)
FIG. 5 is a partial longitudinally sectioned front view of an oil cooler including an inner tube shown in FIG. 4.
Figure 6:
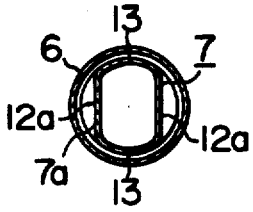
FIG. 6 (PRIOR ART)
FIG. 6 is a sectional view along B—B line of FIG. 5.
Figure 7:
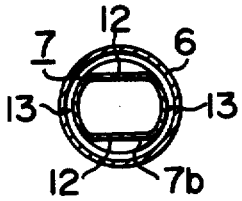
FIG. 7 (PRIOR ART)
FIG. 7 is a sectional view along C—C line of FIG. 5.
Figure 8:
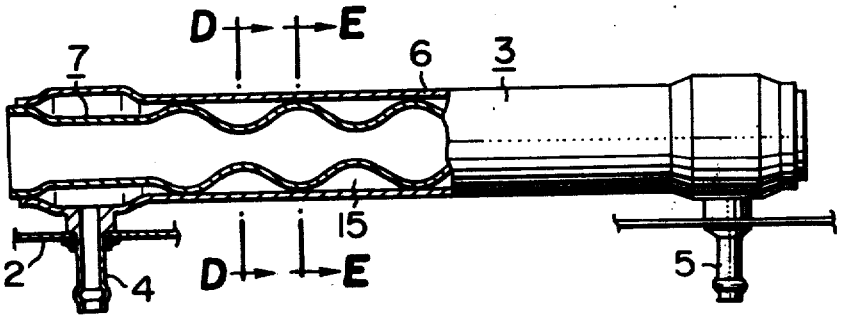
Figure 9:
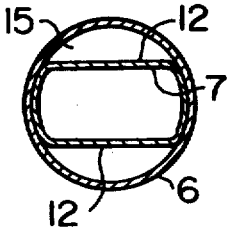
Figure 10:
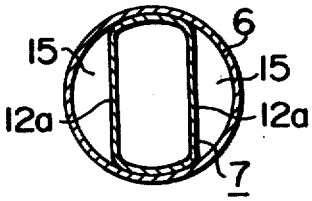

In an oil cooler according to this invention, an inner tube 7 is used as shown in FIG. 4, which tube is provided with dents portions 12, 12 and 12*a*, 12*a* respectively making a pair and alternately formed on upper and lower sides as well as right and left sides, similar to usual oil cooler. However, when said inner tube 7 is fitted within an outer tube 6, inside face of the outer tube 6 and outside face of the inner tube are kept in contact without interposing any gap 13 as in usual case. Namely, outside face of the inner tube excepting the dent portions 12, 12*a* is contacted with the inside face of the outer tube 6 without any gap as shown in FIG. 8 to FIG. 10, oil flowing from the oil duct 4 into the oil space 15 between the outer tube 6 and the inner tube 7 of the oil cooler 3 will go like zigzag sewing between the dent portions 12, 12*a* alternately formed on the outside face of the inner tube 7 and the inside face of the outer tube 6.

Figure 11:
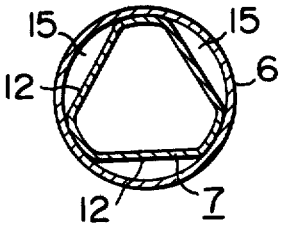
Figure 12:
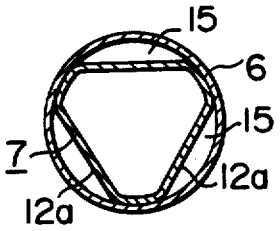

FIG. 11 and FIG. 12 show the 2nd example of this invention, wherein three dent portions 12, 12*a* are formed instead of two dent portions 12, 12*a* formed in pairs on upper and lower sides as well as right and left sides in the 1st example. In this case, the dent portions are alternately formed so as to make dents and projections in axial direction of the inner tube 7.

Figure 13:
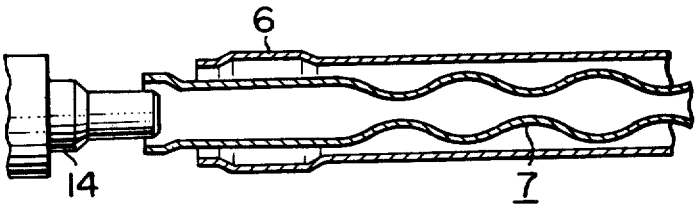
Figure 14:
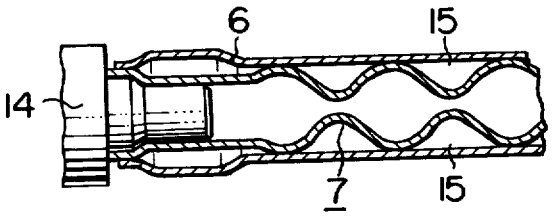

In a so formed oil cooler, when an inner tube 7 is fitted within an outer tube 6, the inner tube having slightly larger outside diameter than inside diameter of the outer tube may be pressed into said outer tube 6 or even though the outside diameter of the inner tube is smaller than the inside diameter of the outer tube, wall of the inner tube 7 is embossed at positions deviating from the dent portions, and at these embossments the outside face of inner tube 7 may be abutted against the inside face of outer tube 6. However, as shown in FIG. 13 and FIG. 14, an inner tube 7 having smaller outside diameter than the inside diameter of an outer tube 6 and a little longer length than the outer tube is inserted into the outer tube 6, then the length of the inner tube 7 is compressed by a compressing punch 14 from both ends thereof, thus causing buckling over whole length of said inner tube to expand its diameter and making the outside face of inner tube 7 in contact with the inside face of outer tube 6 at the outside face of inner tube 7 excepting the dent portions 12, 12*a* or at the projections formed by preliminary embossing, so that the fitting may be effected more easily. By this compression, the projections formed on the inner tube or its wall may be easily moved (buckled) outwards to contact with the inside face of inner tube.

In any case, of the sum total of contact area between the inner tube 7 and the outer tube 6 is made about 20 to 40% of the area of the outside face of inner tube (or the inside face of outer tube), the efficiency as a built-in cooler may be made excellent.

Figure 15:
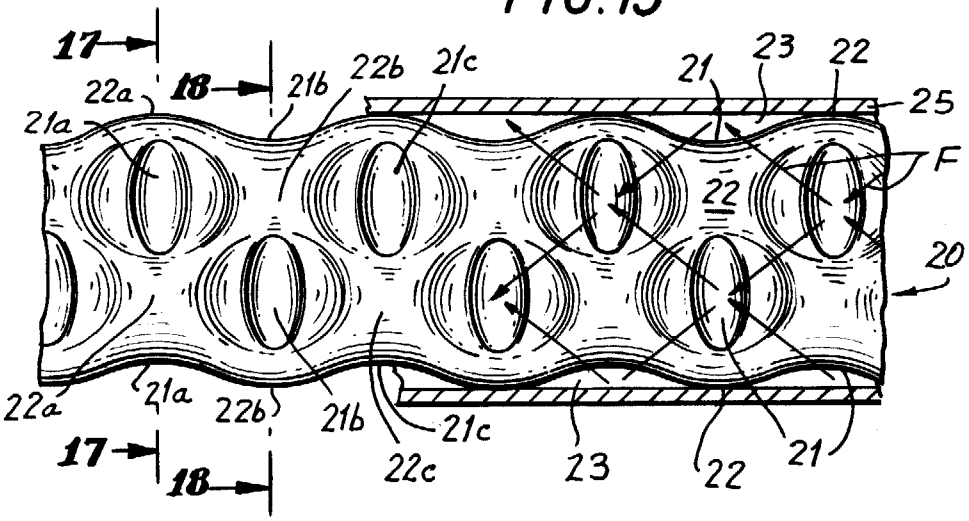
FIG. 15 is a side elevational view of an inner tube constructed and arranged in accordance with the embodiment shown in FIGS. 11 and 12.

Referring now to FIG. 15, a side elevational view of an inner tube 20 and cross-section of an outer tube 25 constructed and arranged in accordance with a preferred embodiment of the invention is shown. Inner tube 20 is a substantially cylindrical tube formed with a repeating series of dent portions 21 and projections 22. A series of dent portions 21 and projections 22 are formed on inner tube 20 on a transverse plane drawn perpendicular to the axis of inner tube 20 and repeat along the length of inner tube 20. An elevational or plan view of inner tube 20 is substantially the same, except for the orientation of dent portions 21 and projections 22. For purposes of the discussion herein, FIG. 15 is considered to represent an elevational view and FIG. 16 is a vertical cross-section along the longitudinal axis of inner tube 20 depicted in FIG. 15.

The outer diameter of inner tube 20 at projections 22 is substantially equal to the inner diameter of outer tube 25. When an oil cooler is assembled and inner tube 20 is inserted into outer tube 25, as shown in FIG. 15, projections 22 are in contact with the inside wall of outer tube 25. Projections 22 are rounded for adjusting the amount of contact between inner tube 20 and outer tube 25. An oil passage 23 is formed between adjacent projections 22 and outer tube 25, thereby allowing oil to pass through dent portions 21 along the length of the oil cooler. This flow of oil through oil passages 23 is indicated by a series of arrows F. Thus, oil flows in the space between outer tube 25 and inner tube 20 in zigzag fashion which assures suitable heat transfer.

Figure 16:
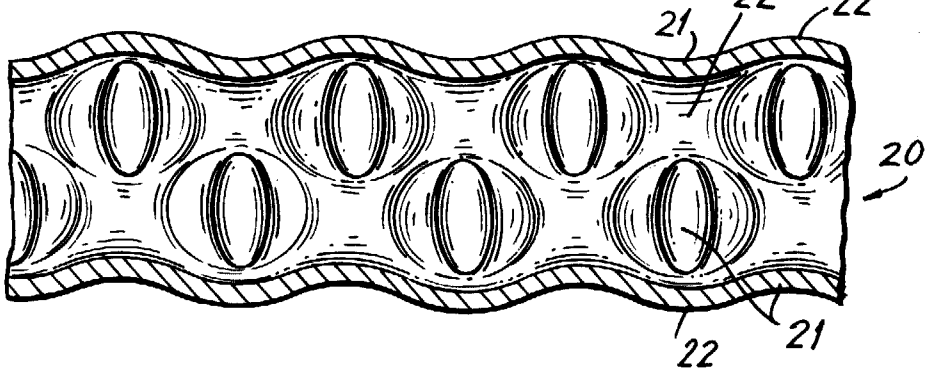
FIG. 16 is a vertical cross-sectional view of the inner tube of FIG. 15.

As shown in cross-section in FIG. 16, dent portions 21 on the outer surface of inner tube 20 project into the inside region of inner tube 20. Similarly, projecting regions 22 projecting outwardly along the outer surface of inner tube 20 form depressions along the wall of inner tube 20.

Figure 17:
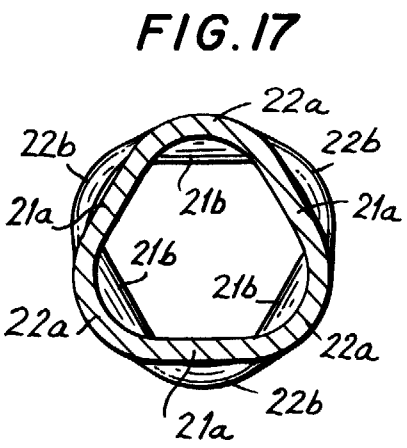
FIG. 17 is a cross-sectional view of the inner tube of FIG. 15 along line 17—17.
Figure 18:
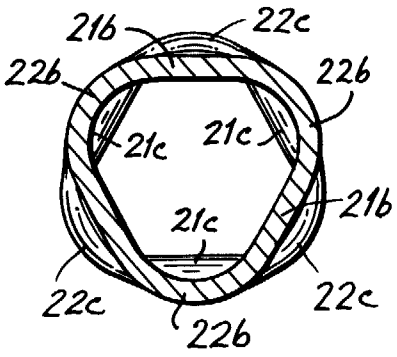
FIG. 18 is a cross-sectional view of the inner tube of FIG. 15 along line 18—18.

Inner tube 20 shown in FIGS. 15-18 is formed with each series having three dent portions 21 at transverse planes along the longitudinal axis of inner tube 20. Each successive series of dent portions 21 has the same number of dent portions, but is rotated from the first series of dent portions so that dent portions 21 in the second series occurs at the angle of the apexes of the first series of dent portions 21. These successive rotating dent portions 21 are best illustrated in FIGS. 17 and 18, wherein cross-sectional views taken along 17—17 and 18—18, respectively, of FIG. 15 are shown.

Referring specifically to FIG. 17, dent portions 21*a* and projections 22*a* in the transverse plane through line 17—17 are shown in section. Dents 21*b* in the transverse plane through line 18—18 are formed at the rotational angle of projections 22*a*. Of course, projections 22*b*, remaining in the undented regions are located at the angle of dents 21*a*. Referring now to FIG. 18, dents 21*c* on the next plane are formed at the same rotational angle as projections 22*b* and dents 21*a* formed in the first plane through line 17—17. When the inner region of inner tube 20 is viewed from the open end, a regular hexagon is seen. The rotated and repeating series of dents 21 and projections 22 forms a regular hexagon in the inner region of inner tube 20 when viewed from an open end.

In the preferred embodiments of the invention, each series of dent portions has an odd number of dents in a plane substantially perpendicular to the axis of inner tube 20. Thus, each series of dents may have three, five, seven, etc. dents and forms a substantially regular polygon of three, five, seven, etc. sides (a regular triangle, pentagon, heptagon, etc.) at the transverse plane. Each successive series of dents is rotated about the longitudinal axis of inner tube 20 so that the apexes or projections 22 are positioned in the mid-point of the preceding dent portions 21. Of course, an end view of the inner region of inner tube 20 shows a regular polygon having twice the number of sides as are formed in each series. In the exemplary embodiment of the invention shown in FIGS. 15–18, tube 20 is formed with series of dent portions having three dents and three projections.

Figure 20:
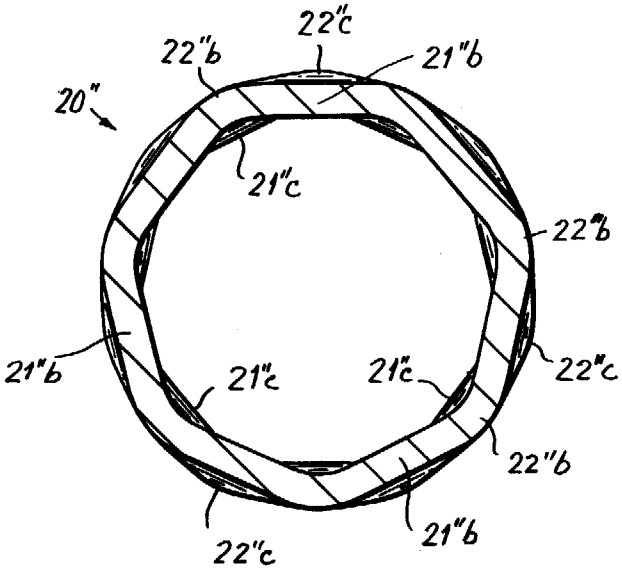
FIG. 20 is a cross-sectional view of an inner tube having seven dent portions in the axial direction thereof.
Figure 19:
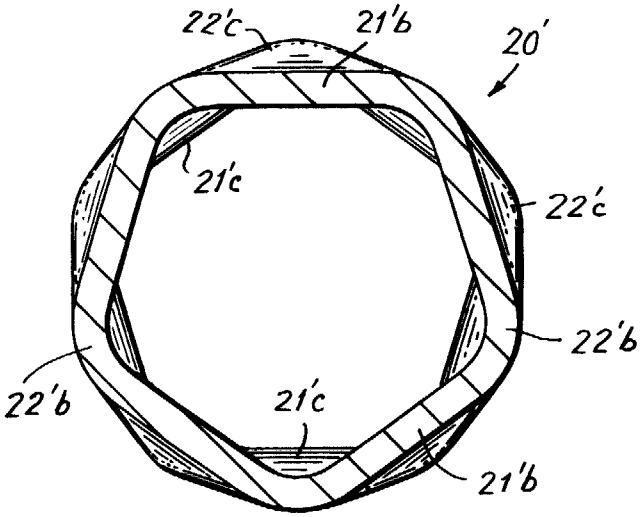
FIG. 19 is a cross-sectional view of an inner tube having five dent portions in the axial direction.

In the further exemplary embodiments of the invention illustrated in FIGS. 19 and 20, tubes 20' and 20'' are formed with a series of five and seven dent portions, respectively. In the cross-sectional view illustrated in FIG. 19, corresponding to FIG. 18, five dents 21'b and five projections 22'b formed in a transverse plane equivalent to the one passing through line 18—18 of FIG. 15. Dents 21'c are formed at the rotational angle of projections 22'b and projections 22'c are formed at the rotational angle of dents 21'b in the next series of dent portions. Similarly, referring to FIG. 20, dents 21''b and projections 22''b are in a transverse plane equivalent to the plane through line 18—18 of FIG. 15. Dents 21''c are formed at the rotational angle of projections 22''b and projections 22''c are formed at the rotational angle of dents 21''b in the next series of dent portions.

By constructing and arranging an oil cooler having an inner tube 20 formed in this manner, an oil cooler having improved heat transfer and ease of manufacture is obtained. Additionally, increased heat exchanger efficiency is obtained when the dent portions and projections are of a size such that the total contact area between inner tube 20 and outer tube 25 lies between about 20 to 40% of the surface area of the inside surface of the outer tube 26 or about 20 to 40% of the surface area of the outside surface of inner tube 20.

The oil cooler built in a radiator according to this invention is constructed as mentioned above, so that oil within the cooler flows zigzag through the oil space 15 and 23 between inner and outer tubes and the heat transfer rate is very good, and the outer tube and the inner tube are kept in contact at dispersed positions, so that deformation of the inner tube due to pressure is little and there is no apprehension to cause any damage due to the fatigue of material, thus large practical effect may be obtained.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An oil cooler built in a radiator comprising:

an outer tube; and an inner tube formed with a plurality of a series of dent portions in the axial direction thereof, each series having an odd number of dents equally spaced about said inner tube with rounded apexes for contacting the inner surfaces of the outer tube, each said series forming a regular polygon having an odd number of sides on a plane perpendicular to the axis of said inner tube and each adjacent said series rotated about the axis of said inner tube so that the apexes of an adjacent series is at the mid-point of the dents of the preceding series;

said inner tube positioned inside said outer tube with said apexes of said inner tube contacting the inner surface of said outer tube for defining oil passages between said tubes at the non-contacting regions whereby oil flows in said oil spaces between said tubes in zigzag fashion along the length of said tubes.

2. The oil cooler of claim 1, wherein each said series has three dents and said regular polygon is a triangle.

3. The oil cooler of claim 1, wherein each said series has five dents and said regular polygon is a pentagon.

4. The oil cooler of claim 1, wherein each said series has seven dents and said regular polygon is a heptagon.

5. The oil cooler of claim 1, wherein from about 20 to 40% of the surface area of the inside surface of the outer tube contacts the outside surface of the inner tube.

6. The oil cooler of claim 1, wherein from about 20 to 40% of the surface area of the outside surface of the inner tube contacts the inner surface of the outer tube.

* * * * *